United States Patent [19]

Wheeler

[11] 4,094,431

[45] June 13, 1978

[54] PAINT TRAY WITH BRUSH HOLDING ATTACHMENT

[76] Inventor: William A. Wheeler, 352 Jefferson St., Glencoe, Ill. 60022

[21] Appl. No.: 654,410

[22] Filed: Feb. 2, 1976

[51] Int. Cl.[2] ..... B44D 3/12; B65D 21/02

[52] U.S. Cl. ..... 220/23.4; 15/257.06; 220/23.86

[58] Field of Search ..... 15/257.05, 257.06, 264; 206/361, 362, 558; 248/110, 111, 210; 401/118, 121; 220/23.4

[56] References Cited

U.S. PATENT DOCUMENTS

| | | | |
|---|---|---|---|
| 775,526 | 11/1904 | Dunbar | 248/111 |
| 930,917 | 8/1909 | Arnold | 15/264 |
| 1,644,612 | 10/1927 | Roberts | 220/85 R |
| 2,659,917 | 11/1953 | Drum | 15/257.06 |
| 2,748,977 | 6/1956 | Sarchet | 206/361 X |
| 2,909,797 | 10/1959 | White | 15/257.06 |
| 3,002,209 | 10/1961 | McKinstry | 15/105 X |
| 3,087,190 | 4/1963 | Werner | 15/257.06 X |
| 3,110,921 | 11/1963 | Conner | 15/257.06 |
| 3,241,175 | 3/1966 | Johnson | 15/257.06 X |
| 3,576,045 | 4/1971 | Stafford | 15/257.06 |
| 3,822,846 | 7/1974 | Jesionowski | 15/257.06 X |

FOREIGN PATENT DOCUMENTS

| | | | |
|---|---|---|---|
| 411,970 | 6/1934 | United Kingdom | 220/23.4 |

*Primary Examiner*—Daniel Blum
*Attorney, Agent, or Firm*—Dressler, Goldsmith, Clement, Gordon & Shore, Ltd.

[57] ABSTRACT

An assembly comprising a paint tray with a paint brush attachment is provided for simultaneously accommodating both a paint roller and a paint brush. The paint tray may comprise a conventional paint tray. The paint brush attachment comprises a receptacle having a front wall, a back wall, a pair of side walls and a bottom wall, with the distance between the side walls being less than the width of the bristled end of the paint brush and greater than the thickness of the bristled end of the paint brush. Clamp means such as a clip is secured to the paint brush receptacle for removably attaching the paint brush receptacle to the paint tray.

8 Claims, 4 Drawing Figures

10
11
12
14
16
18
20
21
22
24
26
30
31
31a
32
34
36
38
40
42
43
44
4.

PAINT TRAY WITH BRUSH HOLDING ATTACHMENT

BACKGROUND OF THE INVENTION

This invention relates to an improved paint tray assembly and, more particularly, to a paint tray with a brush holding attachment for simultaneously accommodating both a paint roller and a paint brush.

Paint rollers have been used for over thirty years, and are typically used with a paint tray that has peripheral walls that surround a sloping bottom wall to define a paint reservoir. The roller is rolled or dipped into the reservoir to gather paint, and is then applied to the surface to be painted to thereby roll the paint thereon. Paint rollers are easy and convenient to use, and make it possible to paint a large surface in a relatively short time.

It is a disadvantage of paint rollers that they cannot be used on or close to woodwork, fixtures or other objects that protrude from the wall, such as door or window molding, electric outlets, and corners. To paint in such locations, it is the practice for painters to carry a separate brush, so that in those small areas which the roller applicator cannot reach, the brush is used.

Since extensive amounts of painting are performed while the painter is on a ladder, it is desirable for the painter to have both a paint roller and an auxiliary paint brush within his reach. Otherwise, the painter must repeatedly go up and down the ladder for his painting implements, and this tires the painter and reduces his efficiency by lessening the percentage of the time that he is actually painting.

Painters have attempted to carry the auxiliary paint brush in various ways, none of which has proven satisfactory. Some painters have attempted to lay the brush on the sloping bottom wall of the paint tray, but this commonly results in the brush sliding downwardly into the paint thereby covering the brush handle with paint, and also has interfered with the dipping of the roller into the reservoir. Other painters have attempted simply to hold the brush in one hand while using the roller in the other hand, but this has proven unsatisfactory because the brush either drips, contacts a surface which it is not desired to paint, or slips from the painter's grasp.

In an attempt to solve the foregoing problem, U.S. Pat. No. 2,909,797 to White discloses a combined paint roller tray and paint brush tray. The paint brush tray is positioned adjacent the forward end of the paint roller tray, and has a transverse dimension greater than the width of the paint brush. This arrangement has the disadvantages that the brush tray protrudes a substantial distance from the roller tray, the brush handle protrudes from the front end of the tray and is likely to be bumped accidentally, and the brush tray can accommodate only a single paint brush.

Other attempted solutions to the problem disclose means for clipping a paint brush to a paint tray, or attaching a paint brush holder to a paint tray. For example, U.S. Pat. No. 3,837,034 to Leffert et al. discloses a paint roller tray with a brush clip secured to one of the side walls for storing a paint brush, but requires that the height of the side walls of the paint tray be greater than is conventional. A paint brush holder for attachment to paint cans is shown in U.S. Pat. No. 2,748,977 to Sarchet. Despite the availability of the Sarchet device for about twenty years, nobody has conceived of a paint brush holder suitable for use with conventional paint trays of various sizes.

Still other attempted solutions to the problem of the temporary storage of a paint brush during use — each of which fails to meet the problem satisfactorily — are disclosed in U.S. Pat. No. 1,764,763 to Stang, No. 2,259,927 to Dunton, No. 2,661,858 to Howell, No. 2,676,730 to Hedglon and No. 2,705,334 to Farrow.

SUMMARY OF THE INVENTION

In accordance with the present invention, a paint tray assembly is provided for simultaneously accommodating a paint roller and a conventional paint brush having an aggregation of bristles with a lateral width several times greater than its thickness. The assembly includes a paint tray such as a conventional paint tray having a plurality of peripheral walls — a front wall, a back wall, a pair of side walls — and an inclined bottom wall, which together define a receptacle having a shallow end adjacent the front wall and a deep end adjacent the back wall. A paint roller is received in the paint tray.

The assembly further includes a paint brush receptacle having a front wall, a back wall, a pair of side walls, and a bottom wall. Clamp means such as a clip is secured to one of the side walls for removably attaching the paint brush receptacle to a wall of the paint tray.

The distance between the side walls of the paint brush receptacle is less than the width of the paint brush at the bristled end thereof and greater than the thickness of the paint brush at the bristled end.

The paint brush is positioned in the paint brush receptacle with the side edges of the bristle resting on the bottom wall of the receptacle. The paint brush can be easily grasped in this position, yet is out of the painter's way so that it is unlikely to be bumped accidentally. The bristles on the paint brush extend in the lateral direction a given distance beyond the handle of the paint brush, and the shallow front end of the paint brush receptacle has a depth no greater than about such distance. Thus, when the paint brush is inserted in the paint brush receptacle, the wider dimension of the aggregation of bristles is oriented in a generally vertical direction. In use, the form of the paint brush receptacle keeps the receptacle substantially free of extra paint, which prevents paint from accumulating within the body of the bristles from whence it is likely to run down or drip down on the painter while he is painting with the brush. This arrangement also permits two or more paint brushes to be stored simultaneously in the paint brush receptacle, and the paint brush receptacle occupies a relatively small percentage of the total area of the assembly.

DESCRIPTION OF THE PREFERRED EMBODIMENT

Figures 1, 2, 3, 4:
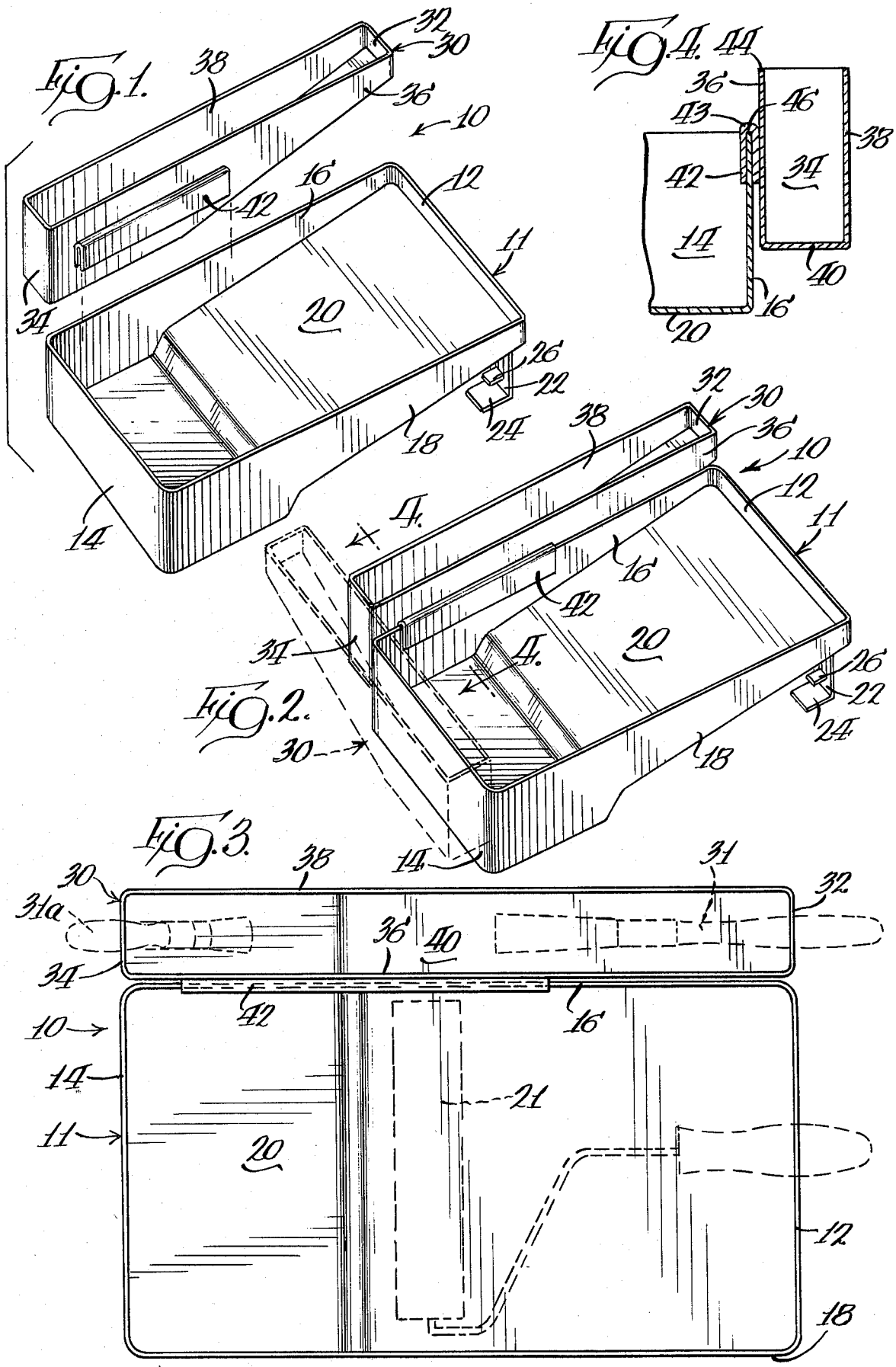
FIG. 1 is an exploded perspective view of the paint tray and paint brush receptacle of the present invention.
FIG. 2 is a perspective view of the paint tray and paint brush receptacle of FIG. 1 in one assembled position, and shows in phantom the paint brush receptacle attached to the paint tray in another position.
FIG. 3 is a plan view of the paint tray and paint brush receptacle of the present invention, with a paint roller and two paint brushes shown in phantom in their temporary storage positions during use of the assembly.
FIG. 4 is a fragmentary cross-sectional view taken along plane 4—4 in FIG. 2.

Referring to the drawing, there is shown an assembly 10 including a paint tray 11 such as a conventional paint tray having peripheral walls 12, 14, 16 and 18, a bottom wall 20, which together define a receptacle for receiving a paint roller 21. The peripheral walls comprise a front wall 12, back wall 14, and a pair of side walls 16 and 18. At least a portion of bottom wall 20 is inclined in such a way that the receptacle has a shallow end adjacent the front wall 12 and a deep end adjacent the back wall 14. Support means such as a pair of spaced-apart brackets 22 can be secured to the bottom wall 20 adjacent the front wall 12 to maintain the shallow end of the paint reservoir in an elevated position. The brackets include a base portion 24 and hook portion 26 by means of which the paint tray can be removably attached to a ladder.

The assembly further includes a paint brush receptacle 30 for receiving at least one conventional paint brush 31 having an aggregation of bristles with a lateral width several times greater than its thickness. Receptacle 30 has a front wall 32, back wall 34, a pair of side walls 36 and 38, and a bottom wall 40. Preferably, the configuration of receptacle 30 corresponds generally to the shape of paint tray 10, except for the width of the receptacle which is described in greater detail below. Thus, at least a portion of bottom wall 40 is inclined in such a way that receptacle 30 has a shallow end adjacent the front wall 32 and a deep end adjacent the back wall 34.

Clamps means such as clip 42 is secured to the paint brush receptacle 30 on the outer surface of one of the side walls, i.e., side wall 36. As shown in FIG. 4, clip 42 has a U-shaped upper end 43 for removably attaching the paint brush receptacle 30 to the paint tray 11. As thus attached, the assembly 10 can simultaneously accommodate paint roller 21 and at least one paint brush 31. Paint brush 31 is stored in receptacle 30 with the side edges of the bristles resting on the bottom wall 40. With this arrangement, the paint brush can be easily grasped, it is out of the painter's way and is not likely to be bumped accidentally and, as shown in FIG. 3, if desired two or more paint brushes 31 and 31*a* can be stored at one time in the receptacle 30. In the embodiment shown, paint brushes 31 and 31*a* are the same size but are disposed at different angles relative to the paint tray, and thus appear differently in FIG. 3. It is a further advantage of this arrangement that receptacle 30 for holding the paint brush takes up only a relatively small portion of the total space of the assembly and does not protrude in an awkard position from the assembly. It is also a feature of the invention that paint brush receptacle 30 is kept relatively free of paint to prevent paint from accumulating within the body portion of the bristles from whence it is likely to run down onto the painter's hand, or drip down from above onto his head and shoulders, while he is using the brush to apply paint.

Since extensive amounts of painting are performed while the painter is on a ladder, such as a step ladder, it is frequently desirable for the painter to attach the paint tray and paint brush receptacle to a rung of the ladder by means of brackets 22 on the paint tray. The painter can thereby attach the assembly to different rungs of the ladder to paint areas at various heights without being required to go all the way up and down the ladder each time the area within his reach is completed.

The width of step ladders varies, as does the width of paint trays which are commercially available. Consequently, the step ladder may be wide enough to accommodate paint tray 11, but too narrow to accommodate the assembly with the paint brush receptacle attached to side wall 16 of the paint tray, as shown in FIGS. 2 and 3. In this instance, the paint brush receptacle 30 can be attached to the back wall 14 of paint tray 11, as shown in phantom in FIG. 2. Thus, the paint brush receptacle 30 can be attached to one of the side walls, i.e., side wall 16 or to back wall 14 so that the assembly can be attached to a rung of the ladder even when the ladder is relatively narrow and the paint tray is relatively wide. To accomplish this, the length of clip 42 preferably is less than the length of back wall 14.

It is desirable to have bottom wall 40 of paint brush receptacle 30 at least as high as bottom wall 30 of paint tray 11 to prevent the paint brush receptacle from separating from the paint tray when the assembly is placed on a surface. By securing clip 42 to side wall 36 of paint brush receptacle 30 at a location which is spaced from bottom wall 40 and from the upper edge 44 of side wall 36, as illustrated in FIG. 4, the bottom wall 40 of the paint brush receptacle will be at least as high as the bottom wall 20 of the paint tray for all of the various sizes of paint trays which are commercially available. With this arrangement, the bottom wall 40 of receptacle 30 is about the same height as bottom wall 20 of paint tray 11 when the paint tray is relatively small, and bottom wall 40 of receptacle 30 is spaced from bottom wall 20 of paint tray 11 when the paint tray is relatively large (FIG. 4). The paint brush receptacle 30 protrudes vertically from the upper edge 46 of the walls of the paint tray by an amount corresponding to the distance between the upper edge of the U-shaped end 43 of clip 42 and the upper edge 44 of side wall 36.

A paint brush receptacle was produced in accordance with the principles of this invention and had a length of about 15 inches and a width of about $2\frac{3}{4}$ inches. The back wall had a height of about $3\frac{5}{8}$ inches and the front wall had a height of about $1\frac{1}{2}$ inches. The bottom wall was flat for about five inches, and from that point was inclined toward the front wall. The clip was about 8 inches long and $1\frac{1}{4}$ inches high, had one end position about $1\frac{1}{2}$ inches from the back wall, and the upper edge of the clamp was spaced about $1\frac{1}{4}$ inches from the upper edge of the side wall. The paint brush receptacle is illustrative only, and the dimensions may vary significantly in accordance with this invention.

As can be seen from the following example, substantial savings of energy, time and money can be achieved by employing the assembly of the present invention.

EXAMPLE

Two rectangular rooms, each with dimensions of 12 feet by 14 feet with an 8 foot ceiling, were painted by an experienced painter using a conventional prior art paint tray to paint one room and the assembly of the present invention to paint the other room. Both rooms were painted with the painter working at substantially the same pace. The wall and ceiling surface of both rooms were pre-sized smooth sheet-rock. Each room had a total test area of 584 square feet and included 121 linear feet of molding, woodwork, electric sockets, base board, and corners to be painted with a brush. An oil base paint was used.

The equipment used for painting with the conventional paint tray was a 4 foot step ladder, a 9 inch roller, a 3 inch paint brush, and one bucket of paint for trimming. For each position of the ladder, the painter accomplished all ladder work within his reach without using a walk board. However, when the painter was on the ladder and using the paint roller, to avoid accidental spilling of the paint bucket he placed the paint brush and paint bucket on the floor, and came down the ladder once for each positioning of the ladder to exchange the paint tray for the paint bucket and brush. Using the conventional paint tray along with a paint bucket in this way, approximately 584 square feet of total area was painted in 78 minutes at an average rate of about 7.49 square feet per minute.

The equipment used for painting with the assembly of the present invention was likewise a 4 foot step ladder, a 9 inch roller, and a 3 inch paint brush. The paint tray with the attached paint brush receptacle simultaneously held both the paint roller and paint brush. For each position of the ladder, the painter attached the assembly to the ladder and accomplished all ladder work within his reach without using a walk board, and without having to come down the ladder for a paint brush. With the use of the assembly of this invention, the total area of approximately 584 square feet was painted in 63 minutes at an average rate of about 9.27 square fet per minute.

Thus, the same amount of painting required approximately 24 per cent more time with the conventional paint tray than with the assembly of this invention — a very significant differential in the painter's time and the consequent cost to the customer. With the present invention, the painter was able to complete all ladder work within his reach each time he climbed the ladder, whereas the conventional paint tray required the painter to leave the ladder once for each position of the ladder before he completed an area being painted. Thus, the assembly of this invention increased the productivity of the painter, reduced the physical demands on the painter by approximately halving the number of times the painter was required to go up and down the ladder, and also eliminated the need for a paint bucket.

The above detailed description of this invention has been given for ease of understanding only. No unnecessary limitations should be understood therefrom, as modifications will be obvious to one skilled in the art.

What is claimed is:

1. An assembly for simultaneously accommodating a paint roller and a conventional paint brush for painting the walls and ceiling of a dwelling, said brush having a handle with an aggregation of bristles extending longitudinally therefrom at one end thereof, said aggregation of bristles having a lateral width several times greater than its thickness, comprising:

a paint tray having a bottom wall which has an incline for at least a part of its length, a front wall, a back wall and a pair of side walls, together defining a receptacle for receiving a paint roller;

a paint brush receptacle havng a front wall, a back wall, a pair of side walls, and a bottom wall, the distance between said side walls of said paint brush receptacle being less than the width of said paint brush at said bristled end thereof and greater than the thickness of said brush at said bristled end, said side walls and bottom wall of said paint brush receptacle having a length about equal to the length of one of the paint tray walls so that said paint brush receptacle will receive said paint brush with the wider dimension of said aggregation of bristles inserted in a generally verticle plane with the handle of the brush extending outwardly from the paint brush receptacle in a position where it may be conveniently grasped by the user, said paint brush receptacle having a length sufficient to accommodate a second of said conventional paint brushes oriented in the same vertical plane; and clamp means secured to said paint brush receptacle for removably attaching said paint brush receptacle to a wall of said paint tray, said paint brush receptacle being attachable to either of said side walls of said paint tray and also being attachable to said back wall of said paint tray.

2. An assembly as defined in claim 1 wherein the greater portion of said bottom wall of said paint tray is inclined; and said paint tray has a shallow end adjacent said front wall and a deep end adjacent said back wall.

3. An assembly as defined in claim 2 wherein said clamp means is secured to one of said side walls of said paint brush receptacle.

4. An assembly as defined in claim 3 wherein said one said wall of said paint brush receptacle has an upper edge, and said clamp means is secured to said one side wall of said paint brush receptacle at a location spaced from both the bottom wall of the paint brush receptacle and from said upper edge of said one side wall.

5. An assembly as defined in claim 1 wherein said bottom wall of said paint brush receptacle is inclined, and said paint brush receptacle has a shallow end adjacent the front wall thereof and a deep end adjacent the back wall thereof.

6. An assembly as defined in claim 2, further including means for supporting said shallow end of said paint tray to maintain said shallow end in an elevated position.

7. An assembly as defined in claim 6 wherein said support means comprises a pair of spaced-apart brackets secured to said bottom wall adjacent said front wall of said paint tray.

8. An assembly as defined in claim 5 wherein said bristles extend in said lateral direction a given distance beyond said handle of said paint brush, and the depth of said shallow end of said paint brush receptacle is no greater than about said given distance so that said wider dimension of said aggregation of bristles when said paint brush is inserted in said paint brush receptacle is oriented in a generally vertical direction.

* * * * *